United States Patent [19]

Gilbert et al.

[11] Patent Number: 4,595,241

[45] Date of Patent: Jun. 17, 1986

[54] DIGGING TOOTH AND HOLDER THEREFOR

[76] Inventors: Jerry F. Gilbert; Jonathan J. Gilbert; Albert J. Gilbert, all of 3549 Bedford St., Dallas, Tex. 75212

[21] Appl. No.: 600,353

[22] Filed: Apr. 16, 1984

[51] Int. Cl.[4] ..... E21C 35/18

[52] U.S. Cl. ..... 299/93; 37/142 R

[58] Field of Search ..... 299/91, 93; 37/142 R

[56] References Cited

U.S. PATENT DOCUMENTS

| | | | |
|---|---|---|---|
| 1,210,366 | 12/1916 | Reisinger | 37/142 R |
| 1,890,997 | 12/1932 | Lane | 37/142 R |
| 2,229,267 | 1/1941 | Younie | 37/142 R |
| 2,263,215 | 11/1941 | Larsen | 37/142 |
| 3,203,488 | 8/1965 | Eastwood | 172/713 |
| 3,357,117 | 12/1967 | Petersen | 142/ |
| 3,629,964 | 12/1971 | Russel | 299/91 |
| 3,737,199 | 6/1973 | Stephenson | 37/142 R |
| 3,778,112 | 12/1973 | Krekeler | 299/86 |
| 3,841,709 | 10/1974 | Kniff | 299/88 |
| 3,856,359 | 12/1974 | Krekeler | 299/92 |
| 3,992,061 | 11/1976 | Rollins | 299/93 |
| 4,316,636 | 2/1982 | Taylor et al. | 299/92 |
| 4,337,980 | 7/1982 | Krekeler | 299/91 |

*Primary Examiner*—Stephen J. Novosad
*Assistant Examiner*—William P. Neuder
*Attorney, Agent, or Firm*—Marcus L. Bates

[57] ABSTRACT

A non-rotatable digging tooth has a forward working portion designed to excavate dirt, with a rearward cylindrical shank portion of a configuration to be removably received within the circular bore of a support block. The block includes a forward projection which forms a shoulder having a face positioned substantially parallel to the axial centerline of the bore. The juncture between the shank and digging part of the tooth is provided with a shoulder made complementary respective to the shoulder on the support block so that the two shoulders confront one another. The confronting shoulders abuttingly engage one another and provide a resisting force which prevents rotation of the tooth respective to the block. The block can be attached to various different trenching and digging apparatus.

8 Claims, 18 Drawing Figures

DIGGING TOOTH AND HOLDER THEREFOR

BACKGROUND OF THE INVENTION

When excavating long trenches with a digging or trenching machine, the geological formation through which the trench extends often changes from highly frangible dirt, to other unconsolidated formations, and then to rock. There are digging implements made especially for penetrating dirt-like formations, and there are other radically different digging teeth especially adapted for forming a trench through rock. For this reason, it would be advantageous to be able to readily substitute a rock-type digging tooth for a dirt-type digging tooth, and vice versa, depending upon the characteristics of the geological formation through which the trench extends.

Swisher U.S. Pat. No. 4,335,921 teaches a cutting head which can be placed within a box wherein the box is designed to receive a cylindrical shank of a digging tooth. Means are provided by which the digging tooth is rendered non-rotatable. College, et al U.S. Pat. No. 4,346,934 also provides means by which the digging teeth are rendered non-rotatable.

The present invention constitutes an improvement over the prior art by the provision of a combination digging tooth and support box wherein the support box and digging tooth cooperate to proclude rotation of the digging tooth, yet the support box bore can also receive rock-type bits of the rotatable type when it is deemed desirable to do so.

SUMMARY OF THE INVENTION

A non-rotatable digging tooth in combination with a support box therefor, wherein the box has a bore adapted to receive a rotatable rock-type bit therein. A shoulder formed at a medial part of the tooth engages a forwardly projecting relief formed on the box, with the tooth shoulder and box shoulder confronting one another when the tooth shank is removably mounted in the bore formed within the box. The box bore is cylindrical and is made complimentary respective to the tooth shank. A keeper of prior art design prevents significant longitudinal movement between the tooth and the box. The confronting shoulders prevent rotational motion of the tooth respective to the box. The box shoulder is a relief which forms a face. The face is spaced from and lies parallel to the longitudinal axial centerline of the box bore. This construction allows the combination to be used on various different excavating apparatus, so that dirt, for example, can be excavated, and when the geology of the ground changes into a hard formation, a rock-type rotatable bit can be rotatably captured within the same box, thereby enabling the rock-type formation to be penetrated by the rock bit, and thereafter, the dirt type digging tooth of the combination can be replaced within the box.

Accordingly, a primary object of the present invention is the provision of an improved combination box and tooth assembly, wherein a dirt type digging tooth is held non-rotatable respective to the box, with the box bore being of a configuration to admit the use of a rotatable type rock bit therewith.

Another object of the present invention is the provision of a dirt type digging tooth in combination with a box having a circular bore, with the box bore being of a design which admits the use of a rotatable type tooth therewith.

A still further object of the present invention is the provision of an improved dirt type digging tooth which is non-rotatably affixed to a support box, with the support box having a forwardly projecting shoulder against which there is received a shoulder formed on a medial part of the digging tooth, so that the digging tooth is non-rotatably captured in a removable manner within the box.

Another and still further object of the present invention is the provision of improvements in non-rotatable type digging teeth for use on digging machines, comprising a tooth and box combination wherein the box has a circular bore formed therein for receiving both a non-rotatable dirt-type digging tooth as well as a rotatable type rock bit, with the non-rotatable type tooth having a shoulder formed thereon which abuttingly engages a shoulder on the box, with there being an interface between the shoulders of the box and tooth which lie in spaced relationship and parallel to the longitudinal axial centerline of the box bore.

An additional object of the present invention is the provision of an improved non-rotatable digging tooth for use in a support box of the type which is designed to receive a rotatable type rock bit therein, wherein the non-rotatable digging tooth has means located thereon which abuttingly engages means located outside of the box bore so that part of the tooth abuttingly engages part of the box and thereby prevents relative rotational motion therebetween.

A further object of the present invention is the provision of an improved non-rotatable digging tooth having a flat ground engaging end of sinusodial wave pattern in cross-section which increases in thickness towards a cylindrical shank, with the shank being received within a cylindrical bore of a support box, and with there additionally being confronting shoulders formed on the digging tooth and the support box which confront one another and thereby prevents relative rotation of the tooth respective to the box.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
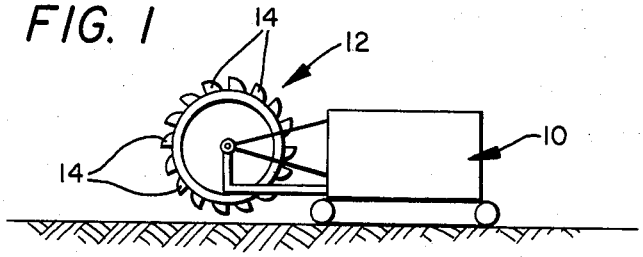
FIG. 1 is a part diagrammatical, part schematical, part cross-sectional side view representative of a prior art digging machine having digging teeth and support boxes associated therewith in accordance with the present invention.
Figure 2:
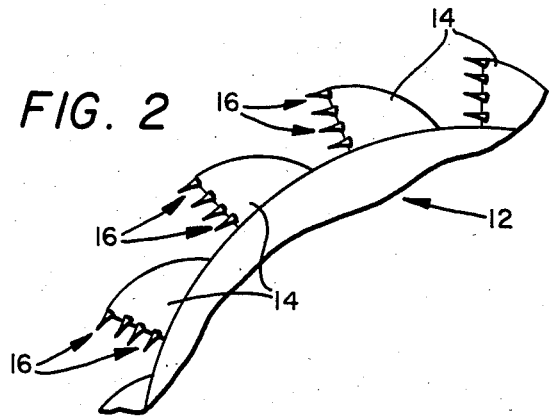
FIG. 2 is a broken, enlarged, detail of part of the digging machine disclosed in FIG. 1.

In FIG. 1, an excavating machine 10, as for example, a trenching machine such as a John Deer or I.H. Corporation, is provided with a digging wheel 12 having buckets 14 circumferentially spaced about the periphery thereof. As seen in FIG. 2, each bucket 14 has a plurality of digging teeth removably attached to a plurality of support boxes, as indicated by the numeral 16.

Figure 3:
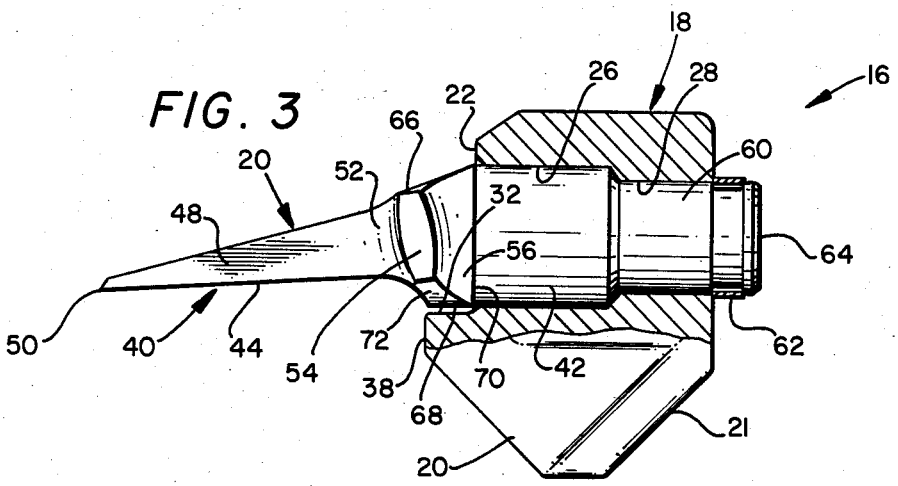
FIG. 3 is a further enlarged, part cross-sectional, side elevational view of a support box and non-rotatable digging tooth made in accordance with the present invention.

In FIG. 3, together with other figures of the drawings, the combination digging tooth and support box 16 comprises a support box 18 to which there is removably attached, in a non-rotatable manner, an improved digging tooth 20. The support box has downwardly converging lower sloped surfaces 19 and 21 by which the box is rigidly attached to a bucket lip in the manner of FIG. 2. The box can be welded to the bucket lip in any number of different manners, and the surfaces 19 and 21 can be arranged at various different angles to achieve the proper alignment of the tooth 20 respective to the bucket lip.

Figure 4:
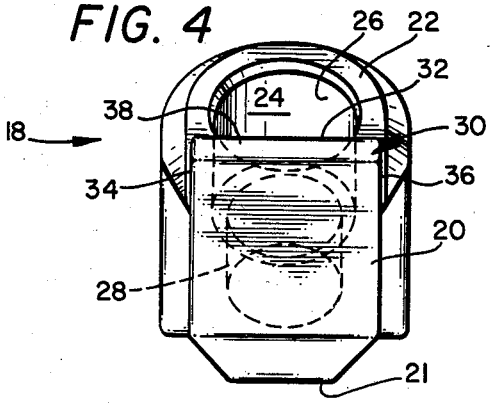
FIG. 4 is a perspective view of part of the apparatus disclosed in FIG. 3.
Figure 5:
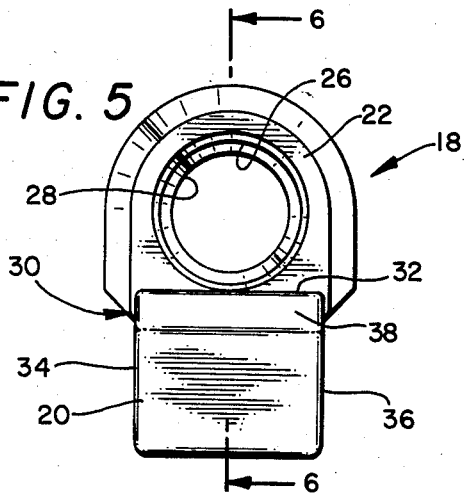
FIG. 5 is a front view of the apparatus disclosed in FIG. 4.
Figure 6:
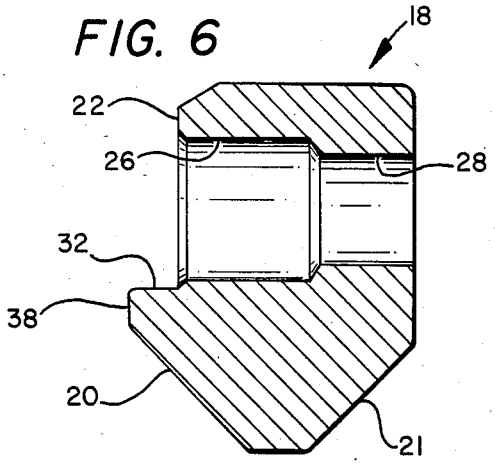
FIG. 6 is a cross-sectional view taken along line 6—6 of FIG. 5.
Figure 7:
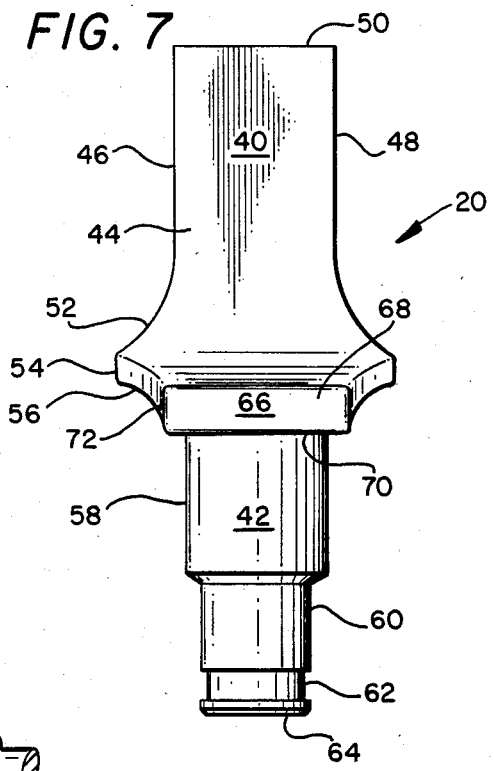
FIG. 7 is a top, plan view of the digging tooth disclosed in FIG. 3.
Figure 8:
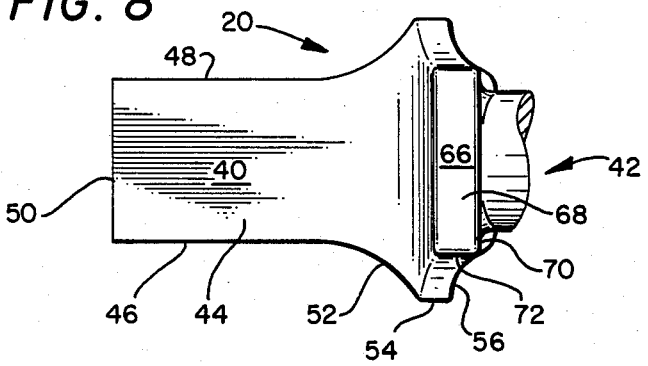
FIG. 8 is an oblique top view of the digging tooth disclosed in FIG. 7, with some parts being broken away therefrom.
Figure 9:
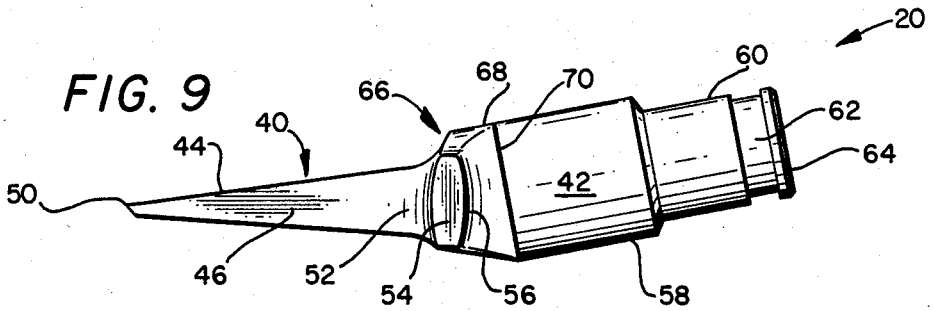
FIG. 9 is a side elevational view of the tooth disclosed in FIG. 7.
Figure 10:
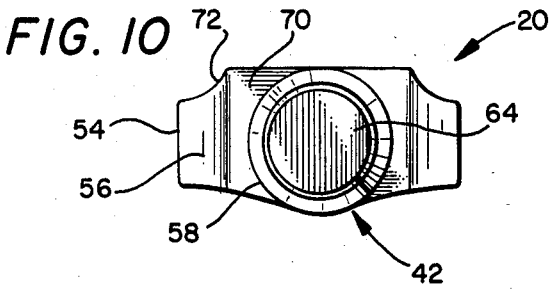
FIG. 10 is a rear view of the tooth disclosed in FIG. 7.
Figure 11:
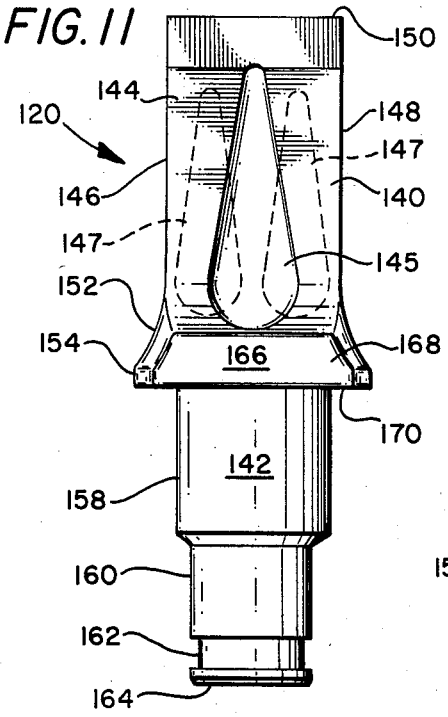
FIG. 11 sets forth a top plan view of a second embodiment of the present invention.
Figure 13:
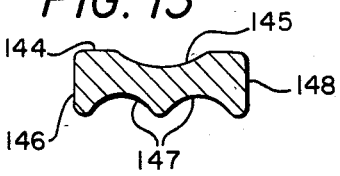
FIG. 13 is a cross-sectional view taken along line 13—13 of FIG. 12.
Figure 12:
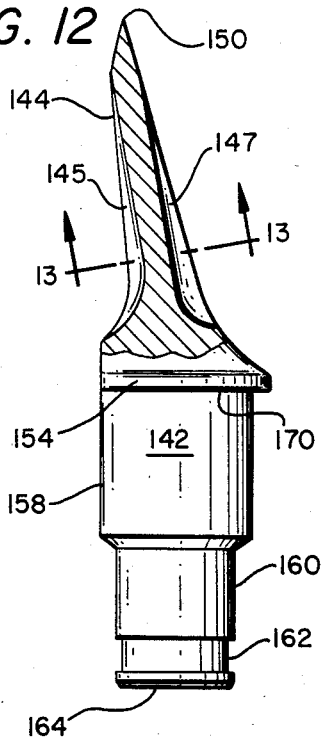
FIG. 12 is a side view of the tooth disclosed in FIG. 7, with some parts being broken away therefrom and the remaining parts being shown in cross-section.
Figure 14:
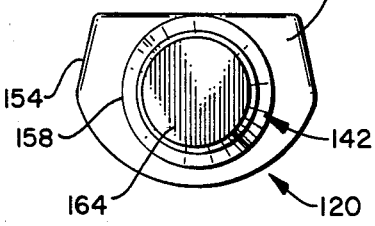
FIG. 14 is an end view of the tooth disclosed in FIG. 11.
Figure 15:
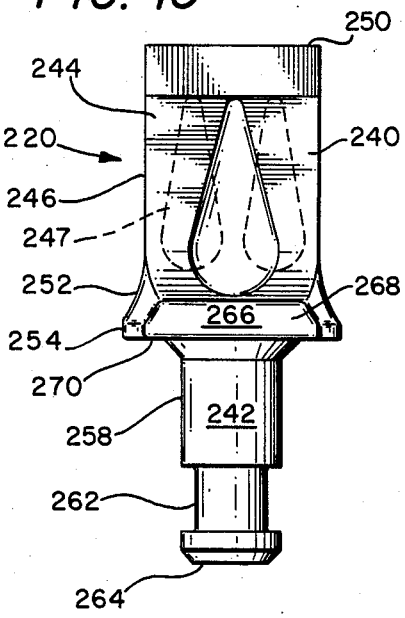
FIG. 15 is a plan view of another embodiment of the present invention.
Figure 17:
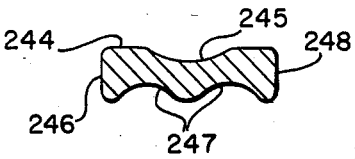
FIG. 17 is a cross-sectional view taken along line 17—17 of FIG. 16.
Figure 16:
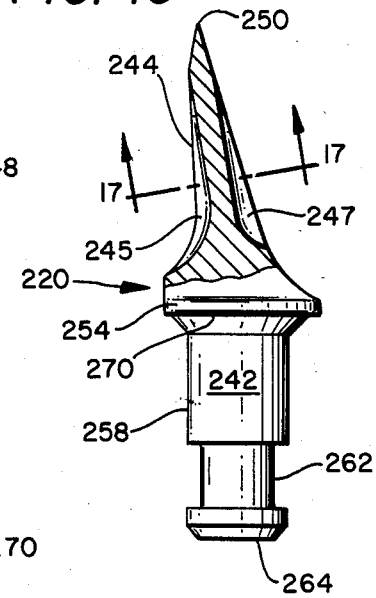
FIG. 16 is a side view of the tooth disclosed in FIG. 15; with some parts being broken away therefrom, and some of the remaining parts shown in cross-section.
Figure 18:
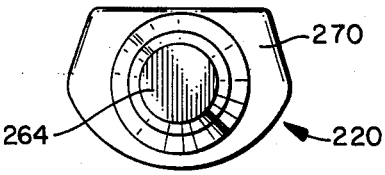
FIG. 18 is an end view of the tooth disclosed in FIG. 15.

As seen in FIGS. 3–6, together with other figures of the drawings, the support box includes an outer face 22 which is perpendicularly disposed respective to the longitudinal axial centerline of a cylindrical bore 24. The bore 24 has a large i.d. length 26 at the entrance thereof which opens into the before mentioned face 22. The rear marginal length of the bore reduces in diameter as indicated by numeral 28. In FIGS. 4 and 5, the arrow at numeral 30 indicates a tang or forwardly projecting lip which forms a shoulder 32. The shoulder 32 is relieved or slightly recessed so that it is spaced slightly below and forwardly of the nearest peripheral wall surface of large i.d. 26. Sidewalls 34 and 36 are opposed to one another and define the lateral dimension of the projection. Numeral 38 indicates the forwardmost wall surface of the support box, which also defines the forward terminal end of the shoulder 32.

Looking now again to FIG. 3, together with FIGS. 7–10, the digging tooth 20 has a forward marginal length in the form of a ground engaging end 40 of substantially flat or blade-like configuration, and a rear marginal length in the form of a shank 42 made integrally therewith, with the shank and blade being diametrically opposed to one another. The blade, in the embodiment of FIGS. 7–10, has a flat portion 44 defined by opposed sides 46 and 48, and a pointed terminal end 50. The sides 46 and 48 each curve outwardly away from one another in the indicated manner of numeral 52, and terminate at its widest portion 54, which is also the medial portion of the digging tooth. The termination at 54 preferably is in the form of an oblated boss having a more or less vertical sidewall as indicated by the numeral 54 in FIGS. 9 and 10. The medial portion of the digging tooth then curves back inwardly as noted by numeral 56, in a direction towards the shank 42. The shank is comprised of large o.d. part 58 and small o.d. part 60. A groove 62 is formed circumferentially about the marginal end of the reduced diameter portion 60 of the shank 42. Numeral 64 indicates the inner terminal end of the digging tooth.

One surface or side of the medial portion 66 of the digging tooth is provided with an outwardly projecting tang which terminates in a shoulder 68. The shoulder 68 lies in a plane which is more or less parallel to the longitudinal axial centerline of the shank 42. Moreover, the shoulder 68 is spaced from the shank axis an amount substantially equal to the distance from shoulder 32 to the axial centerline of the bore 24 of the support box, with there being a slight spacing between shoulders 32 and 68; although, where the criticality of manufacture will permit, it is advantageous for the juxtapositioned shoulders 32 and 68 to slidably engage one another in an abutting manner, with the latter expedient being the most desirable arrangement.

In FIGS. 7–10, numeral 70 indicates a rear wall which forms the rear edge of shoulder 68. The wall 70 preferably is made parallel respective to the wall 22 of the box, so that the wall surface 70 and 22 abuttingly engage one another when the tooth is mated to the support box. Numeral 72 indicates the curvature from shoulder 68 to the oblated surface 54. The outward projection 54 found on either side of the medial part 66 of the tooth enables a tool to be placed between surface 56 and 38 or 22, and the tooth pried in a forcibly manner so that it is removed from bore 24.

In the embodiment of the digging tooth set forth in FIGS. 11–14, wherein like or similar numerals found therein refer to like or similar numerals used throughout the other figures of the drawings, the earth engaging end of the tooth is seen to be in the form of a sinusoidal wave pattern. The wave pattern preferably is formed by a centrally located teardrop shaped depression 145 having the illustrated large concave portion located closely adjacent to the shoulder 168, with the small concave portion of the teardrop depression being located adjacent to the marginal terminal end of the blade in spaced relation respective to the forward end 150, which preferably terminates in the form of a chisel. The opposed surface of the blade is provided with two spaced depressions 147 made slightly smaller than the opposed depression 145, with the two depressions 147 located on one side of the blade straddling the opposed depression 145 located on the other side of the blade. The depressions 146 and 147 enhance the digging action of the blade part of the digging tooth, as well as conserving material of construction.

In the embodiment of the digging tooth disclosed in FIGS. 15–18, the shank is made into a configuration slightly different from the shank found in the first two embodiments of the invention. The shank 242 has a reduced diameter part 262 for receiving a keeper therewithin which is significantly larger than the keeper of the second embodiment. Moreover, the rear wall 270 of the third embodiment is much larger in area as compared to the rear wall surface of the first and second embodiments, because of the difference in the physical dimensions of the blade width.

In each embodiment of the invention, the medial length 66, 166, and 266, which is formed at the juncture of the blade and shank, is provided with a tang which extends laterally from the longitudinal central axis of the shank and terminates in a shoulder 68, 168, or 268. The shoulder lies in a plane which is parallel to a plane passing through the longitudinal axis of the shank. The longitudinal axis of the shank also coincides with the longitudinal axis of the bore 24 formed into the support box. The spacing or shoulders 68, 168, 268 is such that when the shank is slidably received within the bore 24 of the support box, the shoulders 32 and 68 slidably engage one another, or almost slidably engage one another, in a manner whereby any rotational force imparted into the digging tooth is arrested as the two confronting surfaces 32, 68 abut one another as a consequence of the rotational forces, thereby rendering the digging tooth non-rotatable respective to the support box.

The combination of the digging tooth and support box disclosed herein provides a new and unobvious box and tooth assembly which enables most any trencher to dig through different types of geological formations, where a non-rotatable type digging tooth must occasionally be substituted for a rotatable type rock bit. When an extremely hard formation is encountered, and it is found that the progress of the ditch has diminished, the digging teeth of this invention are readily removed from the illustrated support box and a rock-type bit such as is readily substituted therefor, whereupon the digging operation proceeds in an efficient manner until the ditch has been cut through the hard formation, and the dirt-type teeth can then be replaced into the support box of this invention.

There are several unexpected advantages achieved with the present invention of a digging tooth and box combination. As seen illustrated in the figures of the drawings, the profile presented by the forward end of the combination avoids the deleterious clogging effect of debris which must flow about the medial part 66 of the tooth, passed the support box, and into the bucket without clogging the area where the tooth and box mate. The drawbacks of the debris lodging in an area of the combination which makes subsequent disassembly of the tooth from the box unduly difficult has been overcome with this invention. The intervening area between shoulders 32 and 68 is so small that lodgment of debris therein does not affect the digging operation, nor the subsequent disassembly of the tooth from the box. The configuration of the tooth blade and the medial part thereof progressively increases the structural integrity of the tooth in a direction towards the shank, and accordingly, the transfer of digging loads from the blade into the bucket lip occurs in a progressive manner such that there is no isolated forces present to damage or break either the blade or box.

An important and unexpected advantage achieved with the present invention is that the resisting force presented by the blade is transferred by the circumferentially extending wall 70 into the wall 22 of the box, rather than between the confronting shoulders 32 and 68 and accordingly, the forces imposed by the digging action of the apparatus have little tendency to rotate the tooth about its longitudinal axis. Hence, the digging action imparts forces into the confronting walls 70 and 22 in a direction which tends to move the tooth shank rearwardly rather than generating a rotational force about the axial centerline of the shank.

We claim:

1. A non-rotatable digging tooth of the type having a substantially flat ground engaging working end opposed to a cylindrical shank located on the opposed end, with said shank part being of a configuration to be removably received within a cylindrical smooth bore of a support box; the combinations of said tooth and box comprising:

said box has a bottom part for attachment to a digging machine; said box has means forming an outwardly extending shoulder extending forwardly of said bore and located in a plane which is parallel to the axis of the bore;

said tooth is of unitary construction and includes a medial part made into a tooth shoulder which lies parallel to the axis of said shank;

said tooth shoulder is placed in confronting relationship respective to the box shoulder when the tooth shank is received within the bore of the support box so that the confronting faces abuttingly engage one another and thereby prevent axial rotation of the tooth.

2. The combination of claim 1 wherein said box shoulder is a relief spaced below the nearest wall surface that forms the bore, and extends laterally respective to the axis of the bore.

3. The combination of claim 1, wherein the medial part of the tooth has an outwardly directed wall surface which extends from the shank; the box bore terminates at a wall surface which extends outwardly from the bore; the box wall surface and the tooth wall surface are parallel to one another and abuttingly engage each other when the tooth shank is mated with the box bore.

4. The combination of claim 1 wherein said substantially flat working end has means forming depressions on opposed sides thereof which result in the tooth blade assuming a sinusodial wave pattern when viewed in lateral cross-section.

5. The combination of claim 4 wherein said box shoulder is a relief spaced below the nearest wall surface of the bore, and extends laterally respective to the axis of the bore;

wherein the medial part of the tooth has an outwardly directed wall surface which extends from the shank; the box bore terminates at a wall surface which extends outwardly from the bore; the box wall surface and the tooth wall surface are parallel to one another and abuttingly engage each other when the tooth shank is mated with the box bore.

6. The combination of claim 1 wherein said box shoulder is a relief spaced below the nearest wall surface of the bore, and extends laterally respective to the axis of the bore;

wherein the medial part of the tooth has an outwardly directed wall surface which extends from the shank; the box bore terminates at a wall surface which extends outwardly from the bore; the box wall surface and the tooth wall surface are parallel to one another and abuttingly engage each other when the tooth shank is mated with the box bore.

7. A support box and digging tooth for a ditching machine, the box has a cylindrical bore formed therein, one part of the tooth has a cylindrical shank received within the bore, the other part of the tooth is a ground engaging end having a relatively flat working surface, the medial part of the tooth is enlarged for abuttingly engaging an outer surface of the box;

said box has a bottom part for attachment to a digging machine; said box has means forming an outwardly extending shoulder extending forwardly of said bore and located in a plane which is parallel to the axis of the bore;

said tooth is of unitary construction and includes a medial part made into a tooth shoulder which lies parallel to the axis of said shank;

said box shoulder and said tooth shoulder are arranged in confronting relationship and abut one another to prevent relative rotation between the tooth and box when the tooth shank is received within the cylindrical bore of the box.

8. The box and tooth of claim 7 wherein said box shoulder is a relief spaced below the nearest wall surface of the bore, and extends laterally respective to the axis of the bore.

* * * * *